United States Patent [19]

Politte et al.

[11] 4,183,225

[45] Jan. 15, 1980

[54] PROCESS AND APPARATUS TO SUBSTANTIALLY MAINTAIN THE COMPOSITION OF A MIXED REFRIGERANT IN A REFRIGERATION SYSTEM

[75] Inventors: Leo L. Politte; Victor A. Giroux, both of Bartlesville, Okla.

[73] Assignee: Phillips Petroleum Company, Bartlesville, Okla.

[21] Appl. No.: 861,923

[22] Filed: Dec. 19, 1977

[51] Int. Cl.[2] ..... F25B 1/00; F25J 3/02; F25B 43/00

[52] U.S. Cl. ..... 62/114; 62/28; 62/115; 62/512; 62/502

[58] Field of Search ..... 62/115, 114, 503, 512, 62/28, 40

[56] References Cited

U.S. PATENT DOCUMENTS

| | | | |
|---|---|---|---|
| 3,159,008 | 12/1964 | Nebgen | 62/512 |
| 3,444,696 | 5/1969 | Geddes et al. | 62/28 |
| 3,474,633 | 10/1969 | Bailey | 62/512 |
| 3,568,457 | 3/1971 | Briggs et al. | 62/28 |
| 3,882,689 | 5/1975 | Rogers | 62/115 |

*Primary Examiner*—Lloyd L. King

[57] ABSTRACT

Liquid mixed refrigerant is flashed in a vapor-liquid separator from which a portion of the liquid is pumped to an evaporator. The liquid refrigerant boils and partially vaporizes in the evaporator, thereby cooling a process stream. Partially vaporized refrigerant is returned to the separator for separation of vapor from liquid. Separator vapor is countercurrently contacted with a further portion of the separator liquid in a packed section in the upper part of the separator to assure that exiting vapor passing to recompression is saturated with the heavier refrigerant component(s).

8 Claims, 2 Drawing Figures

PROCESS AND APPARATUS TO SUBSTANTIALLY MAINTAIN THE COMPOSITION OF A MIXED REFRIGERANT IN A REFRIGERATION SYSTEM

The invention pertains to the use of mixed refrigerants in a refrigeration system. In another aspect, the invention pertains to a refrigeration process and apparatus. In a further aspect, the invention relates to a vapor-liquid separator.

BACKGROUND OF THE INVENTION

Mixed refrigerants are used in industry for various reasons. They may be used as a matter of convenience when a suitable process stream or streams of suitable composition is available to supply the charge and makeup requirements for the refrigeration system.

Often a mixed refrigerant is preferred since such a refrigerant may have a boiling range rather than essentially a boiling point, as is the case with a substantially pure refrigerant. A refrigerant with a boiling range has advantages when a multicomponent fluid is to be condensed to aid in distributing the condenser load and to reduce overall refrigeration power requirements.

A problem commonly encountered when mixed refrigerants are used in a closed refrigeration system is the tendency for high boiling and low boiling components to segregate in the system. Higher boiling components tend to accumulate in the evaporator, and lower boiling components tend to accumulate in the condenser. When this situation occurs, the evaporator operates at a higher temperature, reducing refrigeration capacity, and the condenser requires a higher pressure to condense refrigerant, all increasing compression power requirements and wasting energy.

BRIEF DESCRIPTION OF THE INVENTION

We have developed a method, a refrigeration system, and an apparatus to overcome the above-described problem with refrigerant mixtures. By our method and system, the composition of the mixed refrigerant is maintained more uniform in composition throughout the system, the condenser capacity of a closed mixed refrigerant system is maintained, and the need for increased compression power requirements is substantially avoided.

In accordance with one aspect of our invention, liquid mixed refrigerant is flashed to near evaporator pressure in a vapor liquid separator means. Refrigerant liquid is pumped in part to evaporator means. The liquid refrigerant partially boils in the evaporator, thereby cooling a process stream. The partially vaporized refrigerant from the evaporator means is returned to the vapor-separator means for separation of vaporous refrigerant from liquid refrigerant. The separated liquid refrigerant is combined with refrigerant liquid. A further portion of the combined refrigerant separator liquid is pumped to the upper portion of the separator means. The separator vapor from both sources is countercurrently contacted with the circulating separator liquid in a packed section in the upper portion of the separator means, thereby assuring that exiting vapor passing to recompression is saturated with the heavier refrigerant component or components. The composition of the refrigerant in the compressor loop thus is maintained more nearly the same as that in the evaporator loop. This reduces the tendency which otherwise would normally occur, that of heavier components tending to concentrate in the evaporator loop and lighter components in the compressor loop.

Figure 1:
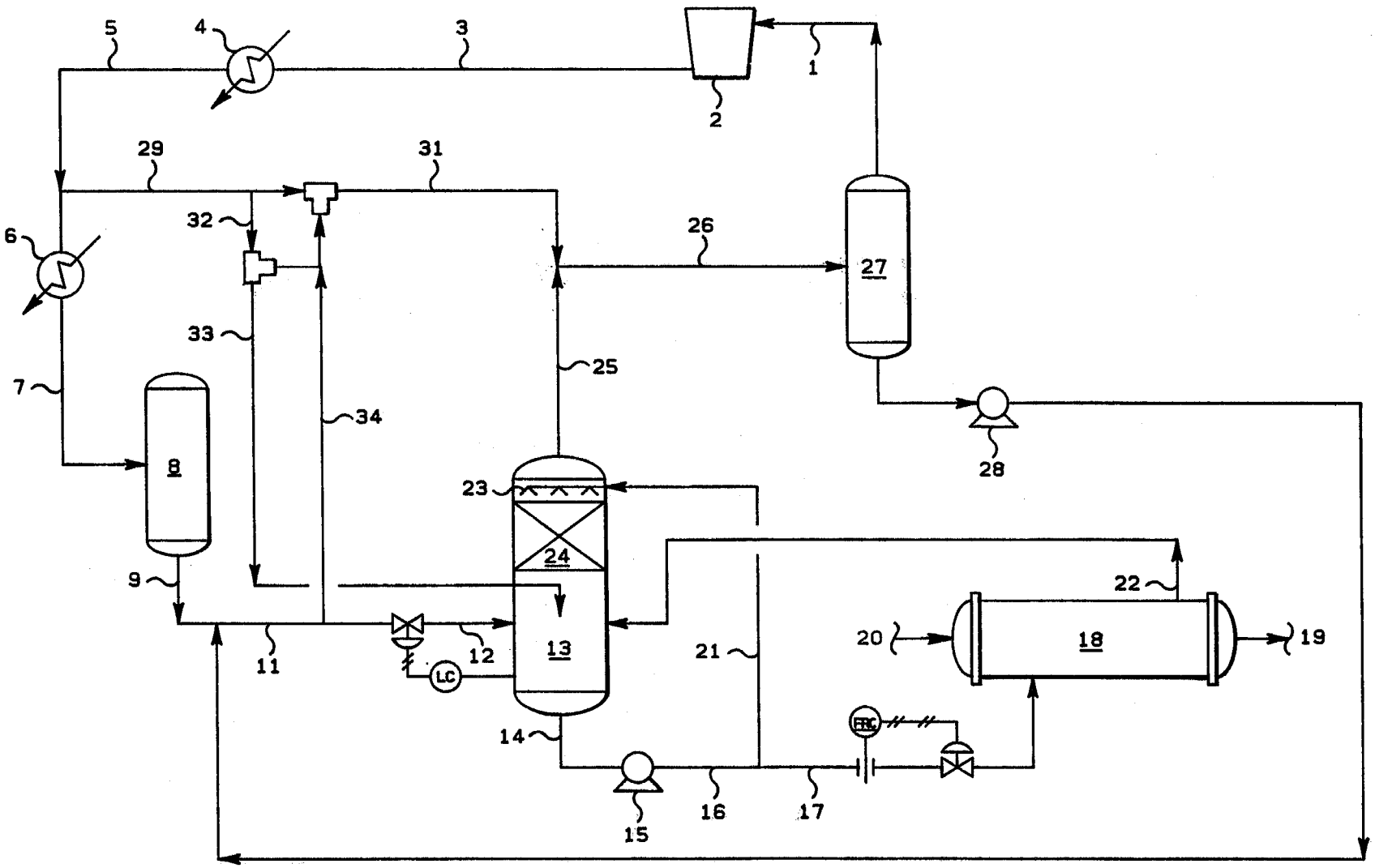
FIG. 1.

A mixed refrigerant stream 1 is compressed 2, condensed 4 and 6, accumulated in a surge tank 8, and flashed into a phase separator 13. Liquid refrigerant 14 from the bottom of the phase separator 13 is circulated 14, 15, 16, 17 to evaporator 18 cool a process stream 19, 20. A mixture of liquid vapor refrigerant exiting 22 from the heat exchanger is brought back 22 to the phase separator 13 and therein flashed. Some of the refrigerant from the bottom of the phase separator 13 is recirculated 21 to the upper area of the phase separator 13, for intimate contact 23, 24, with all vaporous components in the phase separator 13. Thus, all gases exiting 25 from the phase separator 13 are saturated in the lower boiling components, and all gases returned to the compressor 2 are fully saturated with lower boiling components.

FIG. 2:

This figure shows in more detail one construction of a suitable phase separator for use in our refrigeration apparatus and process. The phase separator 13 comprises a vertical, elongated tubular shell, inlet means, preferably in the lower portion, for refrigerant stream 12 from the compessor, mixed vapor/refrigerant stream 22 from the evaporator, liquid refrigerant withdrawal means 14. Liquid refrigerant recirculation pump means 15 provides recirculation 21 of liquid refrigerant to the top of the phase separator, to nozzles 23 or the like, and packing 24 to facilitate saturation of vaporous refrigerant with lower boiling components circulated from the bottom of the separator.

DETAILED DESCRIPTION OF THE INVENTION

A mixed refrigerant gas is compressed, cooled, and condensed. Liquid mixed refrigerant is flashed to near evaporator pressure in a vapor-liquid separator from which liquid refrigerant is pumped with a first portion being returned to the top of the separator, and the remainder passing to an evaporator. The liquid refrigerant partially evaporates in the evaporator, thereby cooling a process stream. Partially vaporized refrigerant from the evaporator is returned to the separator for separation of liquid and vapor. Separator vapor is countercurrently contacted with the circulating separator refrigerant liquid in a packed section in the upper part of the separator to assure that exiting vapor passing to recompression is saturated with the heavier refrigerant component(s). The composition of the refrigerant in the compressor loop thus is maintained more nearly the same as that in the evaporator loop, minimizing concentration of the heavier components in the evaporator loop and the lighter components in the compressor loop.

Our refrigeration process, refrigeration apparatus, and phase separator, are employed in and applicable to closed refrigeration systems employing a mixed refrigerant of at least two miscible components of at least slight difference in boiling points.

In accordance with our process and apparatus, the condenser capacity of a closed mixed refrigerant system is effectively maintained, the composition of the mixed refrigerant system is effectively maintained, the composition of the mixed refrigerant is maintained more uniformly throughout the system, and and the need for increased compression power requirements is avoided. The system comprises a compressor, condenser, phase separator, evaporator, means to circulate refrigerant liquid in part to the evaporator and in part to the top of the separator, and means in the separator to contact refrigerant vapor with refrigerant liquid.

In accordance with one aspect of our invention, liquid mixed refrigerant is flashed into the lower portion of the vertical phase separator means, wherein the refrigerant pressure is reduced to about that of the evaporator inlet pressure providing a separator liquid refrigerant bottom portion, and a vaporous refrigerant overhead.

Phase separator liquid refrigerant is pumped by a suitable high efficiency pump from the bottom of the separator means through the evaporator at a relatively high rate so that only a portion of the liquid refrigerant actually is evaporated in cooling the process stream. This portion evaporated should be a minor portion of the separator refrigerant liquid circulated through the evaporator. Preferably it should be in the range of about 2 to 50 weight percent. Most preferably, in accordance with our work, in the range of about 3 to 20 weight percent of the liquid being circulated is actually evaporated. Thus, the refrigerant fluid circulated from the evaporator is a two phase refrigerant, containing a major portion of liquid, and a minor portion of vapor.

The resultant two phase evaporator effluent fluid of mixed liquid/vapor is returned to the lower portion of the phase separator means and therein flashed to separate vapor and liquid phases. The liquid portion becomes a part of the separator refrigerant bottoms liquid stream, and the vaporous portion passes upwardly through the upper portion of the separator.

A packed section is provided in the upper portion of the phase separator means. This packed section is of sufficient depth and type to insure at least one theoretical separation stage of vapor-liquid contacting.

A side stream of the pumped phase separator refrigerant liquid is taken and sprayed onto or into the top of the phase separator means packing at a rate effective and sufficient to adequately reflux the packing. Such packing typically and effectively can be such as 2" metal pall ring packing. The use of our phase separator with a high efficiency pump to circulate refrigerant liquid in part to circulate through the evaporator, and in further portion to circulate to the top of the separator and down through the packing, maintains effective refrigeration with a mixed refrigerant. All flashed and separated vapors from the refrigerant feed stream to the separator, along with vapors flashed and separated from the two-phase vapor/liquid stream returning back from the evaporator, are contacted with liquid refrigerant taken from the bottom of the phase separator so as to assure that all vapor exiting from the phase separator is saturated with the heavier bottoms refrigerant components. All vapor then is subsequently passed to recompression, normally via a scrubber means. Our invention minimizes any opportunity for heavies to concentrate in the evaporator liquid.

Our system of operation is applicable to any refrigeration system using a mixed refrigerant. Among these are ethane-propane mixed refrigerant such as those of a mol proportion of about 10–90:90–10, and also other mixed refrigerants typically such as ethylene-ethane, isobutane-butane, methane-ethane, methane-ethylene-ethane, and the like.

EXAMPLE

The following Example includes descriptions of the attached Figures. This Example is designed to assist one skilled in the art to a futher understanding of our invention, and should be considered exemplary and not limitative of the scope of our invention.

Our system has been found particularly effective in the operation of a system using an ethane-propane mixed refrigerant. Thus, this refrigerant is used herein to further illustrate our invention, although our invention is not limited thereto. The mixed refrigerant comprises 77 percent ethane, 22 percent propane, 0.85 percent isobutane, and 0.15 percent methane, in mole percent.

As an example and to illustrate our invention, and without being limited to specific amounts, sizes, or relationships, a mixed refrigerant vapor 1, of composition as described, at a rate of about 26,687 lbs. per hr. (12,010 kg/hr) is compressed, such as by a centrifical compressor 2, from about 27 psia (0.186 MPa) and −58° F. (−50° C.) to a compressed gas stream 3 at about 255 psia (1.62 MPa). This hot compressed gas stream 3 is cooled sufficiently 4 to produce a cooled compressed refrigerant stream 7. In the illustrative FIG. 1 attached, this cooling is accomplished in two stages. The initial stage is by partial cooling 4, such as by indirect heat exchange with such as cooling water or air or the like, to produce a partially cooled stream 5 which may be partially condensed, and then further cooled by indirect heat exchange 6, refrigerant means such as by use of propane, ammonia, or the like, to produce a cool condensed compressed stream of liquid refrigerant 7. The liquid refrigerant preferably is accumulated in a surge tank 8 operating for example at about 18° F. (−8° C.) and 221 psia (1.52 MPa).

The condensed refrigerant in surge tank 8 is withdrawn 9 and conveyed 11, 12, to phase separator 13 where it is flashed to substantially the evaporator inlet pressure. There is, of course, a necessary let-down valve (throttling valve) on line 12 shown tied in with the level control LC to the phase separator. Phase separator 13 operates for example at about −86° F. (−66° C.) and 30 psia (0.206 MPa). Input of the liquid refrigerant stream 12 is controlled by the liquid level control LC shown in conjunction with line 12 and separator 13. The flashing of the refrigerant in the phase separator produces a liquid refrigerant bottoms, and a vaporous refrigerant. The bottoms tends to be richer in the heavier boiling component or components. The vapor tends to be richer in the lighter boiling component or components.

Liquid refrigerant stream 14 from the phase separator 13 is circulated at the rate of about 78,000 lb/hr (35,400 Kg/hr) by a suitable high efficiency pump 15 via line 16, 17, to the evaporator or condenser 18 which cools by indirect heat exchange a product stream 19, 20. For this example, the liquid refrigerant to the evaporator can serve as a demethanizer condenser to handle a product stream 20 at a rate of 23,000 lb/hr (10,400 kg/hr) at a rate of about 23,000 lbs. per hr. (10,400 kg/hr) entering at 20 at a temperature of such as about −4° F. (−20° C.) and exiting 19 at a temperature of such as about −70° F. (−57° C.). In cooling the product stream, e.g., a heat source, by indirect heat exchange, the liquid refrigerant is partially evaporated or vaporized, forming a two-phase vapor/liquid refrigerant stream 22 for return to the phase separator.

The now partially evaporized refrigerant, such as about 4 percent vaporized, is returned 22 to the lower portion of phase separator 13. In phase separator 13, not only the entering stream of refrigerant stream 12, but also the return two-phase stream 22 of partially vaporized refrigerant liquid each is flashed. The vapor phase separation of these two streams in the phase separator provides a refrigerant liquid bottoms, which is circulated in part as a bottoms stream 14 from the phase separator 13 to the evaporator 18. At the same time, a portion of the refrigerant stream 14 is circulated by such as a suitable pump 15 through line 16, 21 as a side stream back to the upper area of the phase separator 13. This side stream or recycle stream 21, at the rate of such as about 7,000 lb/hr (3175 Kg/hr) of liquid refrigerant in accordance with our material balance, circulated 21 to the top of phase separator 13, is distributed 23 over and through packing 24 so as to effectively and thoroughly saturate by countercurrent contact the upwardly passing flashed and separated vapors with refrigerant richer in heavier components of the refrigerant. This process assures that the exiting vapors 25 from phase separator 13 contain a maximum saturation of all refrigerant components, and most importantly in accordance with our invention, saturation with the heavier component or components of the mixed refrigerant.

A comparison of the compositions of the vapor and liquid phases in phase separator 13 illustrates the strong tendency for heavies component or components, isobutane in this example, to concentrate in the liquid phase:

| | Compositions, Mol Percent | | |
|---|---|---|---|
| | Refrigerant Circulation | Phase Seperator Inlet | |
| | | Vapor | Liquid |
| Methane | 0.15 | 0.37 | 0.02 |
| Ethane | 77.0 | 93.45 | 67.21 |
| Propane | 22.0 | 6.11 | 31.46 |
| Isobutane | 0.85 | 0.07 | 1.31 |
| | 100.0 | 100.0 | 100.0 |

The now saturated flashed vapors are taken overhead 25 and conveyed 26, preferably via scrubber 27 to the re-compression 1. The scrubber removes entrained liquid which is returned to phase separator 13 via 28.

As is well known in the art of refrigerant control, and as illustrated by the flow diagram of FIG. 1, a hot gas bypass line 29 can take partially cooled refrigerant 5 via lines 29, 31, to admix with the vaporous overhead 25 from phase separator 13 to form feed 26 to the scrubber 27, in times of low refrigerant requirement so that the compressor operates efficiently. Alternatively, partially cooled refrigerant 5 can be taken 29, 32, and 33 to the phase separator 13 for flashing therein, bypassing the surge tank 8 when further refrigerant cooling in accordance with the scheme shown in FIG. 1 is not required at 6. Alternatively, liquid refrigerant can be taken from line 11 by line 34 to bypass separator 13, and taken 31 to mix with overhead vapors 25 to provide feed 26 to scrubber 27 at times of low condenser load or the like. These controls provide a system readily balanced to control load requirements for the compressor.

Figure 2:
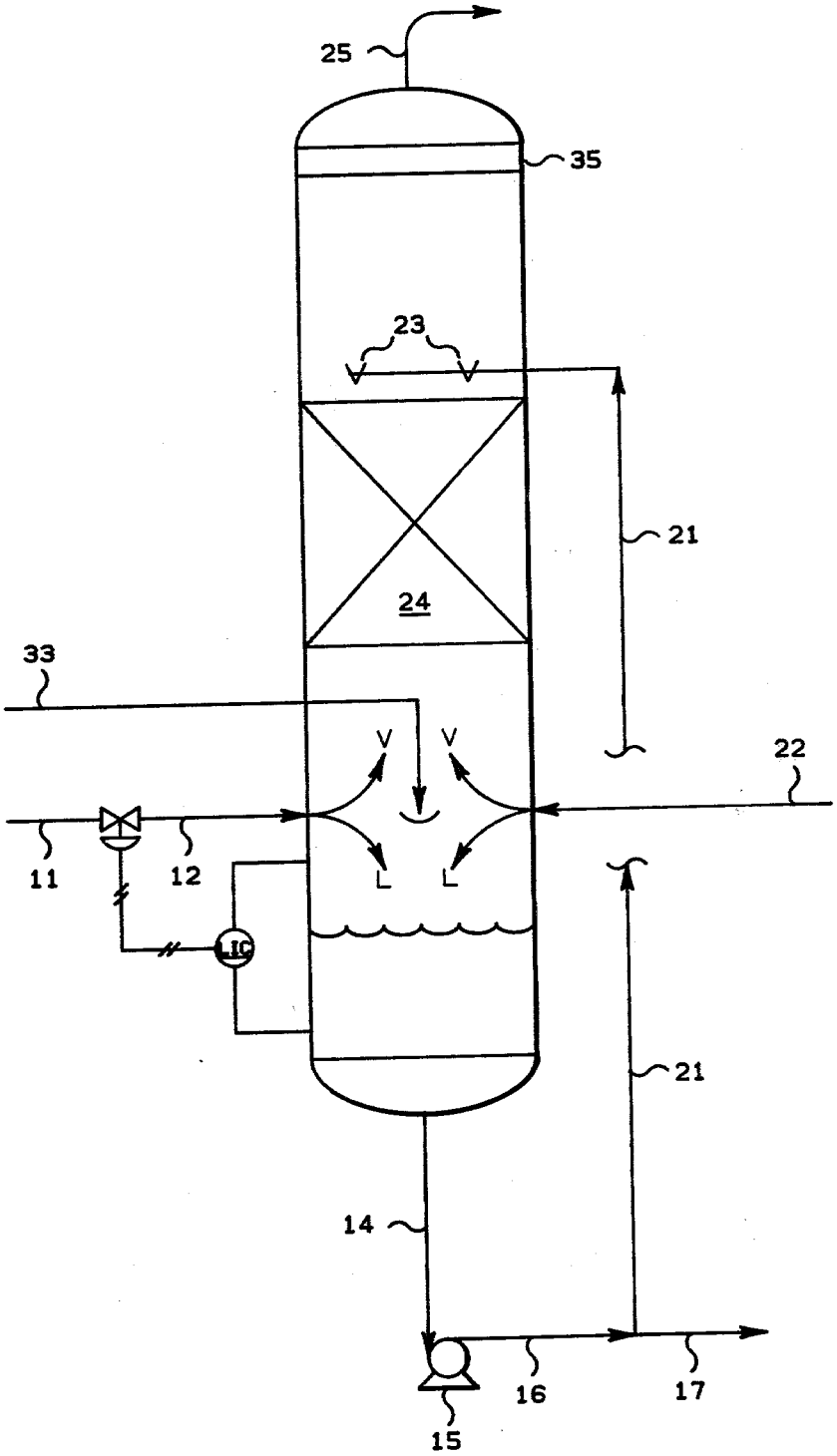

One aspect of a suitable phase separator itself 13 is shown in more detail in FIG. 2 of our attached drawings. Briefly, the phase separator 13 in accordance with one aspect of our invention shown in FIG. 2 comprises a vertical elongated shell of steel or alloy as dictated by the temperature and pressure conditions of the system, with a height:diameter ratio of such as about 3:1 to 6:1, and in the example herein about 17':4'. The separator contains therein in the upper portion packing 24, such as berl saddles, raschig rings, helices, wire mesh, or the like, preferably a mist separator or eliminator such as a mesh type pad 35 located thereabove to prevent liquid entrainment in the gases exiting to the compressor, exit means 25 located toward the top of the phase separator, liquid refrigerant withdrawal means 14 located toward the bottom of the phase separator, inlet means 12 to receive refrigerant, inlet means 33 to receive optional hot bypass gas, inlet means to receive the two phase flow 22 from the heat exchanger or evaporator, inlet means located above the packing to receive the bypass refrigerant bottoms 21 and distribution means such as jets or spray nozzles 23 directly recycle liquid bottoms over the packing in order to saturate gases passing upwardly through packing 24 with the bypass liquid refrigerant, and liquid level controls located in the bottom portion of the phase separator so as to control therein the level of liquid refrigerant. FIG. 2 shows the high capacity circulating pump means such as a centrifugal pump 15 in bottoms line 14, producing stream 16 from which bypass refrigerant 21 is taken back to the upper area of the phase separator 13, and refrigerant for circulation 15 to a heat exchanger or evaporator as shown in FIG. 1. Partially vaporized refrigerant is received back 22 from the heat exchanger as two-phase flow 22 to the phase separator 13 where it is separated between vapor and liquid phases. The refrigerant received 12 is flashed partly to vapor and partly to liquid. Combined liquid refrigerant is cycled as has been described. Combined vapor from both sources is taken up through the packing 24, saturated with heavier components by contacting in the packing with the recycle refrigerant 21, 23, and taken overhead 25 ultimately to recompression as shown in more detail in FIG. 1.

Reasonable variations and modifications are possible within the scope of our disclosure, including our drawings and our claims here appended.

We claim:

1. In a process of cooling employing a mixed refrigerant, the process which comprises:

(a) compressing a hot mixed refrigerant gas, comprising at least one lower boiling and at least one higher boiling component, to a hot compressed gas stream, (b) cooling said hot compressed gas stream, thereby producing a cooled liquid refrigerant, (c) flashing said cooled liquid refrigerant to produce a first vaporous stream richer in lighter components, and a first liquid refrigerant richer in heavier components, (d) contacting at least a portion of a liquid refrigerant cycle stream hereinafter recited with a heat source, thereby cooling in part said heat source, and warming and partially vaporizing said liquid refrigerant cycle stream to produce a two phase vapor/liquid refrigerant, (e) separating said two phase vapor/liquid refrigerant, producing a second vaporous stream and a second liquid refrigerant, (f) combining said second liquid refrigerant and said first liquid refrigerant as said liquid refrigerant cycle stream, (g) combining said first and second vaporous streams as a combined vapor stream, (h) contacting said combined vapor stream with a further portion of said liquid refrigerant cycle stream, thereby at least partially saturating said combined vapor stream with said heavier components to produce said hot mixed refrigerant gas.

2. A process wherein a refrigerant feedstream containing at least two refrigerant components of differing boiling points and comprising a first minor portion thereof in the form of vapor and a second major portion thereof in the form of entrained liquid is passed into a liquid-vapor separation zone to separate said liquid from said vapor, a refrigerant liquid is flashed in said separation zone, the thus separated liquid and liquid from flashing collects as a liquid body at least slightly higher in higher boiling components in a lower portion of said liquid vapor separation zone, vapors from said separating and said flashing produce a combined vapor stream, contacting said combined vapor stream with a portion of said liquid body, thereby saturating said vapor stream with the components of said liquid body, and passing said saturated vaporous material to compression means, thereby maintaining effective saturation of said vapor with said heavier components.

3. A process of refrigeration including an evaporation loop, and a compression loop, which process comprises:

compressing a mixed refrigerant comprising at least one lighter component and at least one heavier component to produce a hot compressed stream, cooling said hot compressed gas stream to thereby condense said stream to a cold refrigerant liquid stream, flashing said cold liquid refrigerant stream in a phase separator means, thereby producing a first liquid bottoms and a first vapor overhead, passing said first liquid bottoms in admixture with a second liquid bottoms hereinafter recited at least in part to a heat source, thereby partially cooling said heat source, and producing a partially vaporized two phase stream of refrigerant, separating said partially vaporized two phase stream of refrigerant in said phase separator means, producing said second liquid bottoms in admixture with said first liquid bottoms, and a second vaporous overhead combined with said first vaporous overhead, intimately contacting said combined vaporous overhead with a recycle portion of said admixture of liquid bottoms, thereby saturating said vaporous overhead with the heavier components of said mixed refrigerant, and producing a saturated overhead mixed refrigerant, cycling said saturated overhead mixed refrigerant to said compressing step, thereby substantially avoiding concentrating heavier components in the evaporation loop, and lighter components in the compression loop of said refrigeration process.

4. A refrigeration process comprising the steps of:

(a) flashing a liquid mixed refrigerant comprising at least one heavier and at least one lighter component into the upper portion of an enclosed phase separation chamber, thereby vaporizing a portion of said refrigerant, (b) accumulating the unvaporized liquid refrigerant in a lower portion of said phase separation chamber, thereby establishing a liquid refrigerant level in said chamber, (c) passing a portion of said liquid refrigerant in indirect heat exchange with a stream requiring cooling, thereby at least partially cooling said stream, and at least partially vaporizing a minor portion of said liquid refrigerant, (d) returning said at least partially vaporized liquid refrigerant to said phase separation chamber, thereby separating vaporous components therefrom, and accumulating said liquid components as a portion of said liquid refrigerant, and wherein said separated vaporous components admix with said first vaporous components, to form a combined vaporous overhead, (e) cycling a portion of said liquid refrigerant to the upper portion of said chamber in intimate contact with said combined vaporous overhead, thereby substantially saturating said vaporous overhead with components of said liquid refrigerant, producing an overhead stream substantially saturated in heavier refrigerant components, (f) recompressing said substantially saturated vaporous overhead to produce a hot compressed stream, (g) cooling said hot compressed stream to produce said liquid mixed refrigerant.

5. The refrigeration apparatus suitable to maintain the composition of a mixed refrigerant comprising, in operable relationship, compression means, cooling means, conduit means for hot compressed refrigerant gas from said compression means to said cooling means, phase separator, conduit means for cooled liquid refrigerant from said cooling means to said phase separator, conduit means for vaporous refrigerant overhead from said phase separator to said compression means, evaporator, high efficiency means to circulate liquid bottoms refrigerant from said phase separator in part to said evaporator and in part as recycle to said phase separator, conduit means for two phase gas/liquid refrigerant from said evaporator to said phase separator;

wherein said phase separator comprises an elongated generally vertical shell, upper outlet means to withdraw refrigerant overhead vapor, mist separator means below said upper outlet means, inlet means below said mist separator for said recycle liquid bottoms, packing below said recycle inlet means, inlet means below said packing for said two-phase refrigerant, inlet means below said packing to receive cooled liquid refrigerant, and means to flash said cooled liquid refrigerant and said two-phase refrigerant to produce an upper vaporous portion and a liquid lower portion, wherein said phase separator is adapted for intimate contact of said upper vaporous portion with said recycle liquid refrigerant in said packing.

6. The refrigeration apparatus according to claim 5 further incorporating scrubber means to receive said refrigerant overhead vapor from said phase separator, circulation means to pass vaporous refrigerant from said scrubber means to said compression means, and means to circulate liquid refrigerant from said scrubber means to said phase separator.

7. The refrigeration apparatus according to claim 5 further incorporating surge means to receive said cooled liquid refrigerant from said cooling means, and to pass said cooled liquid refrigerant to said phase separator to said flashing means.

8. A phase separator comprising a vertically elongated shell, vapor outlet means in the upper portion of said shell, mist separation means positioned below said vapor outlet means, inlet means below said mist separation means to receive liquid bottoms recycle, packing below said bottoms recycle inlet means, inlet means below said packing to receive two phase vapor/liquid, inlet means below said packing to receive cooled liquid, flash means below said packing to flash cooled liquid and two-phase vapor/liquid, liquid level control means suitable to maintain liquid level in said shell below said flash means, and means to recycle liquid bottoms from said liquid lever area of said shell to the upper portion of said shell above said packing.

* * * * *